United States Patent [19]

Berokoff

[11] 4,128,240

[45] Dec. 5, 1978

[54] TENNIS RACKET

[76] Inventor: Andrew J. Berokoff, 508 Allis Dr., Montebello, Calif. 90640

[21] Appl. No.: 735,683

[22] Filed: Oct. 26, 1976

[51] Int. Cl.[2] ..... A63B 49/08

[52] U.S. Cl. ..... 273/75

[58] Field of Search ..... 273/26 B, 29 A, 67 R, 273/72 R, 73 R, 73 J, 75, 81 R, 81.4, 165

[56] References Cited

U.S. PATENT DOCUMENTS

| | | | |
|---|---|---|---|
| D. 125,602 | 3/1941 | Wheeler et al. | 273/81.4 X |
| 472,006 | 3/1892 | Walker et al. | 273/81.4 X |
| 1,648,354 | 11/1927 | Lied | 273/81.4 X |
| 2,710,190 | 6/1955 | Schimansky | 273/81.4 X |
| 3,518,024 | 6/1970 | Wilson | 273/67 R X |
| 3,674,268 | 7/1972 | Shellman | 273/67 B X |
| 3,865,370 | 2/1975 | Rogers | 273/84 R |

FOREIGN PATENT DOCUMENTS

| | | | |
|---|---|---|---|
| 134426 | 9/1949 | Australia | 273/75 |
| 211792 | 2/1924 | United Kingdom | 273/75 |

*Primary Examiner*—Richard J. Apley
*Attorney, Agent, or Firm*—Marvin Jabin

[57] ABSTRACT

A tennis racket grip which is modified so as to enable a tennis player to hold the racket in such a way that it is automatically positioned at a good hitting angle and is kept at a good angle throughout the stroke. The grip also enables the player to obtain top spin and reverse spin on the ball for both forehand and backhand strokes.

5 Claims, 10 Drawing Figures

TENNIS RACKET

BACKGROUND OF THE INVENTION

Novice tennis players find that one of the most difficult aspects of the game to master is to learn how to hold the racket properly. It is necessary to hold the arm in an unnatural position in order to position the racket at the correct angle when it impacts the ball, if the player desires to maintain the maximum control over the ball, especially if it is desired to cause the ball to spin upon leaving the racket. There have been a number of improvements in rackets which have resulted in improved shapes and new materials out of which the rackets are made, but none of the improvements have enabled the player, especially a novice, to obtain the desired control over the ball.

SUMMARY OF THE INVENTION

According to the preferred embodiment of the present invention, a tennis racket includes a grip in the handle having a hole or holes therein through which the player can insert the index finger, thereby making it easier to position the racket at the desired hitting angle. The preferred finger hole is at an angle and of a size and configuration to accommodate the finger comfortably.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

DESCRIPTION OF THE PREFERRED EMBODIMENT

Figure 1:
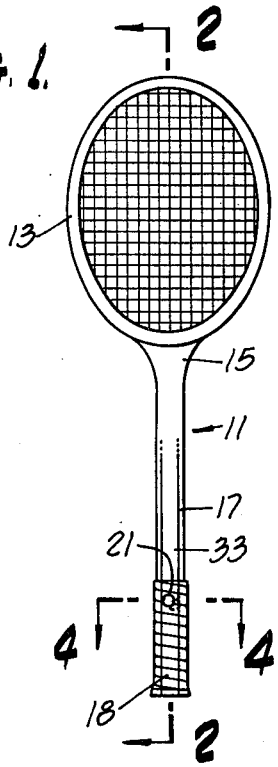
FIG. 1 is a plan view of a tennis racket according to the present invention.
Figure 2:
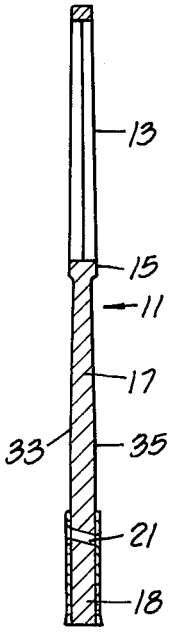
FIG. 2 is a view taken along the line 2—2 of FIG. 1.

Turning now to the drawings, FIGS. 1 and 2 show tennis racket 11 having a frame member 13, a throat number 15, a handle 17 and a grip 18. The finger hole 21 is located in grip 18.

Figure 3:
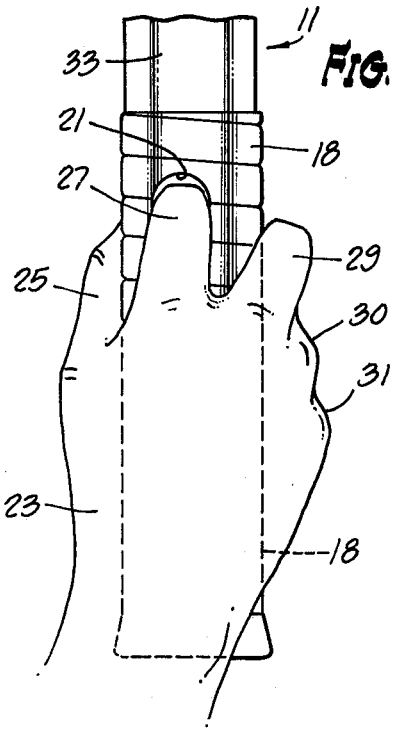
FIG. 3 is a view of a portion of the grip of the racket shown in FIG. 1 being held in the hand.

FIG. 3 shows the grip 18 of the tennis racket 11 being held in the hand 23 of a tennis player. The player's thumb 25 is wrapped around the left side of grip 18, the index finger 27 is inserted within the hole 21, and the other fingers 29, 30, 31 are wrapped around the right side of grip 18.

The center of finger hole 21 can be located approximately three to seven inches from the bottom of grip 18, but approximately 5½ inches from the bottom has been found to be preferred for a comfortable grip.

Figure 4:
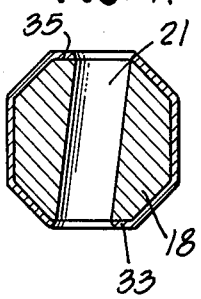
FIG. 4 is a view taken along the line 4—4 of FIG. 1.

FIG. 4 shows how finger hole 21 is not perpendicular to the front surface 33 or the rear surface 35 of grip 18. It has been found that finger hole 21 can be oblique by as much as 45°.

Figure 5:
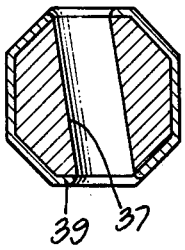
FIG. 5 is a sectional view of a different embodiment of the present invention.
Figure 6:
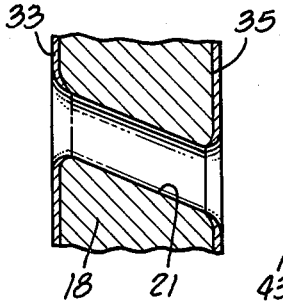
FIG. 6 is a sectional view showing the grip of FIG. 2 in greater detail.

FIG. 5 shows another embodiment whereby the finger hole 37 can be oblique in the opposite direction by as much as 45° from the perpendicular to the front surface 39, to accommodate a different grip or a left-handed player. FIG. 6 is an enlarged view of the finger hole 21 shown in FIG. 2, to show more clearly how the finger hole 21 extends downwardly from the front surface 33 toward the rear surface 35. It has been found that finger hole 21 can be angled downwardly by as much as 45°.

Figure 7:
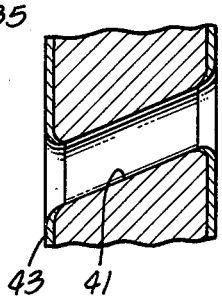
FIG. 7 is a sectional view of a different embodiment of the grip of the present invention.

FIG. 7 shows another embodiment whereby the finger hole 41 can extend as much as 45° upwardly from the perpendicular to the front surface 43.

If it is preferred to decrease the number of variations that are to be constructed, the finger hole 21 can be positioned a little lower on the front surface 33 of grip 18 than might otherwise be designed so that if an upwardly extending hole is desired, the racket 11 can simply be rotated 180° in the hand, and held with the opposite surface facing the player. The finger hole 21 can even be perpendicular to the front surface 33 and neither upwardly nor downwardly in direction, if the minimum number of possible variations is desired.

It has been found that finger hole 21 can be ⅜ to 1⅜ inches in diameter, to accommodate many variations in finger size, and oval in configuration. In additiion, several finger holes of varying sizes can be provided in the same handle, to accommodate a child or an adult using the same racket.

The larger hole may require special reinforcement or distortion of the walls of the handle grip in the vicinity of the finger hole. The reinforcement may be integrally fitted within the walls of the grip, as by adding material in a laminated form, or by shaping the grip so that it is strong enough, even with the finger hole, to sustain whatever forces are caused by the impact with a tennis ball. The walls can also be reinforced by the addition of material to the outside of the walls adjacent to the finger hole.

Figure 8:
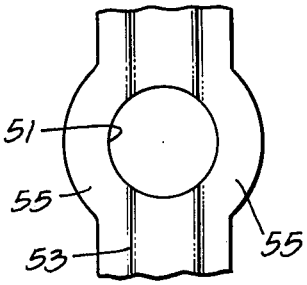
FIG. 8 is a plan view of a different embodiment of the grip of the present invention.

FIG. 8 shows another finger hole 51 in grip 53. The walls 55 of grip 53 in the vicinity of hole 51 have been thickened, as shown, to reinforce the grip 53. The larger finger hole 51 would otherwise have walls that would be so thin as to result in a weak handle that might break easily. The thickening of the walls by adding material, or the use of laminated layers, is designed to avoid a weak handle.

Figure 9:
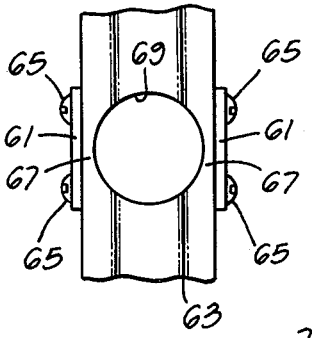
FIG. 9 is a plan view of a different embodiment of the grip of the present invention.

FIG. 9 shows how metal, wooden or plastic supports 61 can be affixed to the grip 63 by means of screws 65, to reinforce the walls 67 of finger hole 69, which might otherwise be too weak.

Figure 10:
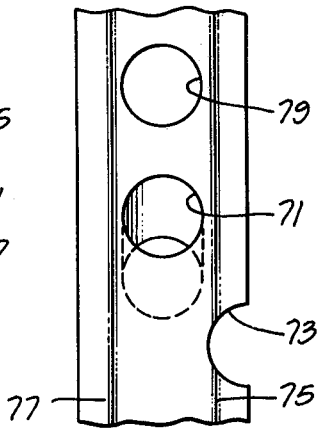
FIG. 10 is a plan view of a different embodiment of the grip of the present invention.

FIG. 10 shows how in addition to the finger hole 71, an opening 73 is provided in the front surface 75 of grip 77. The use of opening 73 enables the player to insert the index finger in opening 73, if it is found to be more comfortable to do so than to use finger hole 71. Opening 73 can also be used as a support by inserting the index finger in hole 71 and the middle finger in opening 73. A left-handed player can simply grasp the grip 77 from the other side by rotating it 180°. Finger hole 79 is also provided, in order to enable the player to use finger hole 71, which extends downwardly from front surface 77, to serve the ball, and then to switch to finger hole 79, which is perpendicular to the front surface 77, for regular play.

The described invention will enable even a novice tennis player to hold the racket so that it will automatically be positioned at a good hitting angle, and be kept at a good angle throughout the stroke. The finger hole will also enable a good player to obtain better control for top spin and reverse spin on the ball as it leaves the racket, and will enable a novice to become more adept in achieving top spin and reverse spin strokes sooner than otherwise. The finger hole is at an angle and of a size and configuration to accommodate the index finger comfortably and can be used by children as well as by adults.

Although a tennis racket has been shown and described, the present invention also related to similar implements used in the games of badminton, lacrosse, squash and table tennis, and whether the handle is solid or made of tubular metal. If made of tubular metal, the grip would have to be modified so as to permit the finger hole to be installed between the metal tubes.

While particular embodiments of the present invention have been shown and described, it will be obvious to those skilled in the art that changes and modifications may be made without departing from this invention in its broader aspects, and that the intention is to cover all such changes and modifications as fall within the true spirit and scope of this invention.

I claim:

1. A tennis racket including:

(a) a head for striking a ball, (b) an elongated shaft extending from said head, and (c) a hand grip extending from said shaft and having front and rear surfaces and at least two side surfaces, said hand grip having at least one hole extending obliquely therethrough from said front surface to said rear surface, said hole being of sufficient size and configuration to permit a person holding said tennis racket to insert a finger therethrough.

2. Apparatus as defined in claim 1 in which the thickness of the walls of said grip in the vicinity of said opening is enlarged to provide extra strength and to prevent said opening from structurally weakening said grip beyond the limit for usage of said racket to strike a ball.

3. Apparatus as defined in claim 1 in which the walls of said grip in the vicinity of said opening are reinforced to provide extra strength and to prevent said opening from structurally weakening said grip beyond the limit for usage of said racket to strike a ball.

4. Apparatus as defined in claim 1 in which said hand grip has at least two holes extending therethrough from said front surface to said rear surface, each of said holes being of a different size so that said grip can be held by persons who have fingers of different sizes.

5. Apparatus as defined in claim 4, in which at least one of said holes has a side that is not completely enclosed, so that a person holding said tennis racket can place a finger into said hole and remove said finger therefrom laterally.

* * * * *